United States Patent [19]

Jamison

[11] 4,056,961

[45] Nov. 8, 1977

[54] METHOD AND APPARATUS FOR FORMING CYLINDRICAL SPACERS FROM METAL BLANKS

[76] Inventor: Eugene M. Jamison, 27640 Gateway Drive, Apt. 107, Farmington Hills, Mich. 48024

[21] Appl. No.: 739,649

[22] Filed: Nov. 8, 1976

[51] Int. Cl.[2] ..... B21C 47/00; B21D 5/12

[52] U.S. Cl. ..... 72/148; 72/149

[58] Field of Search ..... 72/148, 149, 124, 134, 72/166, 169, 310, 321, 368; 113/116 UT

[56] References Cited

U.S. PATENT DOCUMENTS

| | | | |
|---|---|---|---|
| 437,420 | 9/1890 | Clause | 72/149 |
| 2,555,708 | 6/1951 | Scully | 72/166 |
| 2,662,573 | 12/1953 | Cichoski et al. | 72/166 |
| 3,172,448 | 3/1965 | Schoenfeld, Jr. | 72/148 |
| 3,490,260 | 1/1970 | Lindmark | 72/169 |

FOREIGN PATENT DOCUMENTS

| | | | |
|---|---|---|---|
| 720,680 | 11/1965 | Canada | 72/149 |
| 986,854 | 3/1965 | United Kingdom | 72/148 |
| 557,848 | 12/1943 | United Kingdom | 72/166 |

*Primary Examiner*—Michael J. Keenan

*Attorney, Agent, or Firm*—Cullen, Settle, Sloman & Cantor

[57] ABSTRACT

Apparatus for forming cylindrical spacers from metal blanks includes a base plate mountable upon a support with a series of spaced uprights upon the base plate. A die bar spans and is secured to said uprights. A bending roll shaft is arranged parallel to and spaced from said die bar and is rotatively journalled upon said uprights. The roll shaft has an elongated slot adapted to supportably receive the edge of one or more blanks to be formed. A rotative drive is connected to said roll shaft whereby said blank is guidably interposed between the roll shaft and die bar and adapted to wrap around the roll shaft during rotation thereof. Provision is made for stripping the formed spacers from the roll shaft. The method of forming cylindrical spacers from flat metal blanks comprises the steps of rotatively mounting a slotted bending roll shaft upon a horizontal axis and assembling and interlocking the lower edge of one or more blanks down into the roll bar slot. A further step includes advancing said blanks and wrapping said blanks around said roll shaft while holding them in registry with said roll shaft to simultaneously form a plurality of said spacers. A final step includes successively stripping the formed spacers from the roll shaft.

1 Claim, 7 Drawing Figures

METHOD AND APPARATUS FOR FORMING CYLINDRICAL SPACERS FROM METAL BLANKS

BACKGROUND OF THE INVENTION

Heretofore, it is known in the art to provide involved and complicated machines by which a strip of material is cut into blanks and the blanks formed into cylindrical spacers for high production of such spacers.

SUMMARY OF THE INVENTION

It is an object of the present invention to provide a very simplified apparatus for forming cylindrical spacers from metal blanks whereby limited numbers of such spacers may be formed as needed for the immediate use of the artisan requiring such spacers.

It is another object to provide the greatly simplified apparatus for forming cylindrical spacers from metallic blanks such as may be used as gutter spacers wherein, from rectangular blanks of predetermined length, a series of cylindrical spacers may be simultaneously formed in a simple bending operation.

It is another object to provide an improved and simplified method for forming cylindrical spacers from metal blanks.

These and other objects will be seen from the following specification and Claims in conjunction with the appended drawings in which:

THE DRAWINGS

It will be understood that the above drawings illustrate merely a preferred embodiment of the invention and method and that other embodiments are contemplated within the scope of the Claims hereafter set forth.

DETAILED DESCRIPTION OF THE INVENTION

Figure 6:
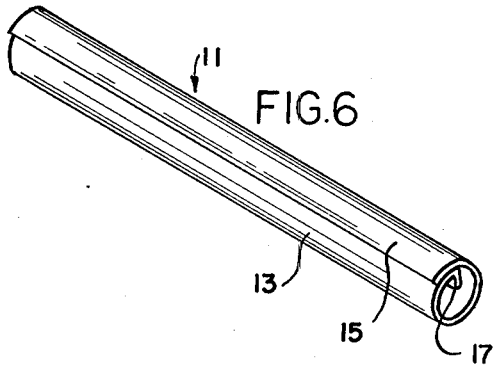
FIG. 6 is a perspective view on an enlarged scale of the formed spacer.
Figure 7:
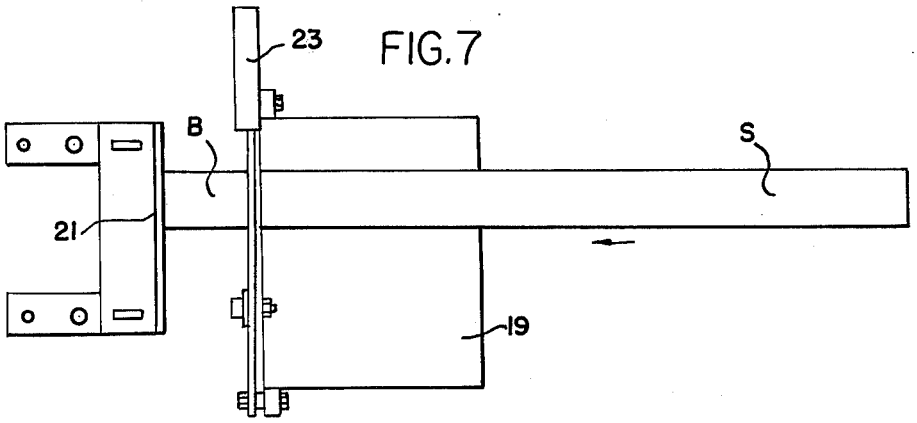
FIG. 7 is a fragmentary plan view of apparatus for shearing metal blanks from a strip of stock.

Referring to the drawings, the present invention is directed to the method and apparatus for forming cylindrical spacers 11, FIG. 6, from metallic blanks B cut from the strip of stock S, FIG. 7. The finished cylindrical spacer may have a number of uses and is particularly adapted as a gutter spacer but without limitation as to the ultimate use. The spacer includes a cylindrical body 13 formed from the rectangular blank B of FIG. 7 including outer overlap edge 15 and the internal radial flange 17.

Figures 1, 2:
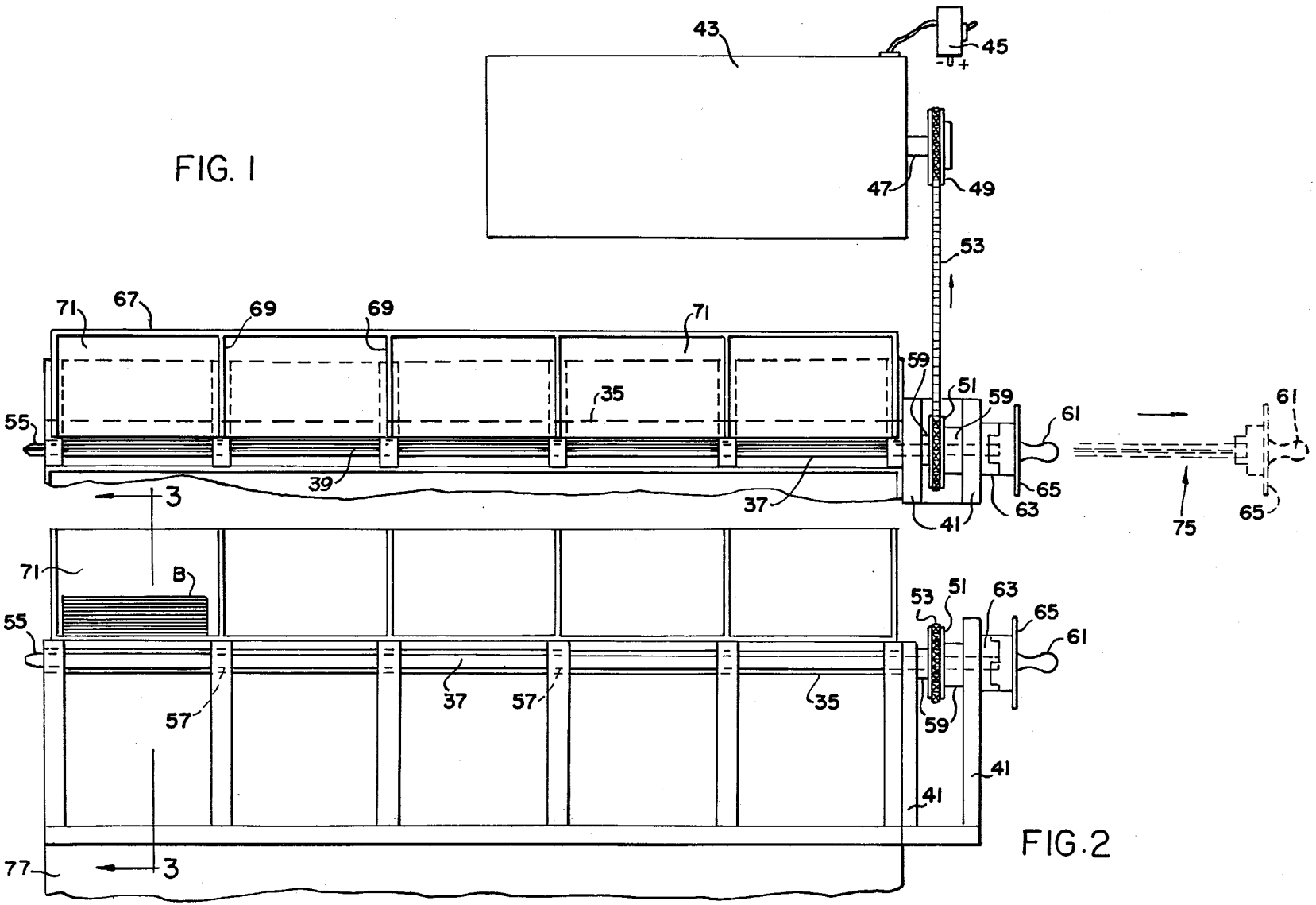
FIG. 1 is a fragmentary plan view of the present apparatus for forming cylindrical spacers from metal blanks.
FIG. 2 is a fragmentary front elevational view thereof.

As a preliminary step, the metallic strip of stocks is mounted upon the table 19 with respect to the adjustable stop 21 and is severed into blanks by the shear 23, pivotally mounted upon the table. This provides a plurality of said blanks such as shown in a stack of blanks in FIG. 3 or a plurality of stacks such as shown in FIG. 2, within the series of stock chambers 71.

The present spacer forming apparatus is generally indicated at 25 and includes the horizontally disposed base plate 29 which is mountable upon and suitably secured to support 27, fragmentarily shown.

Upon said base are secured a series of longitudinally spaced uprights 31. A rearwardly offset top plate 33 spans top edges of the uprights 31 and is suitably secured thereto adding rigidity to the apparatus.

Elongated die bar 35, circular in cross section, for illustration, is spaced above and arranged parallel to base plate 29 and extends through and spans and is secured to the respective uprights 31.

Elongated bending roll shaft 37 is arranged parallel to and spaced forwardly of said die bar, extends through and is rotatively journalled upon supports 31.

Figure 3:
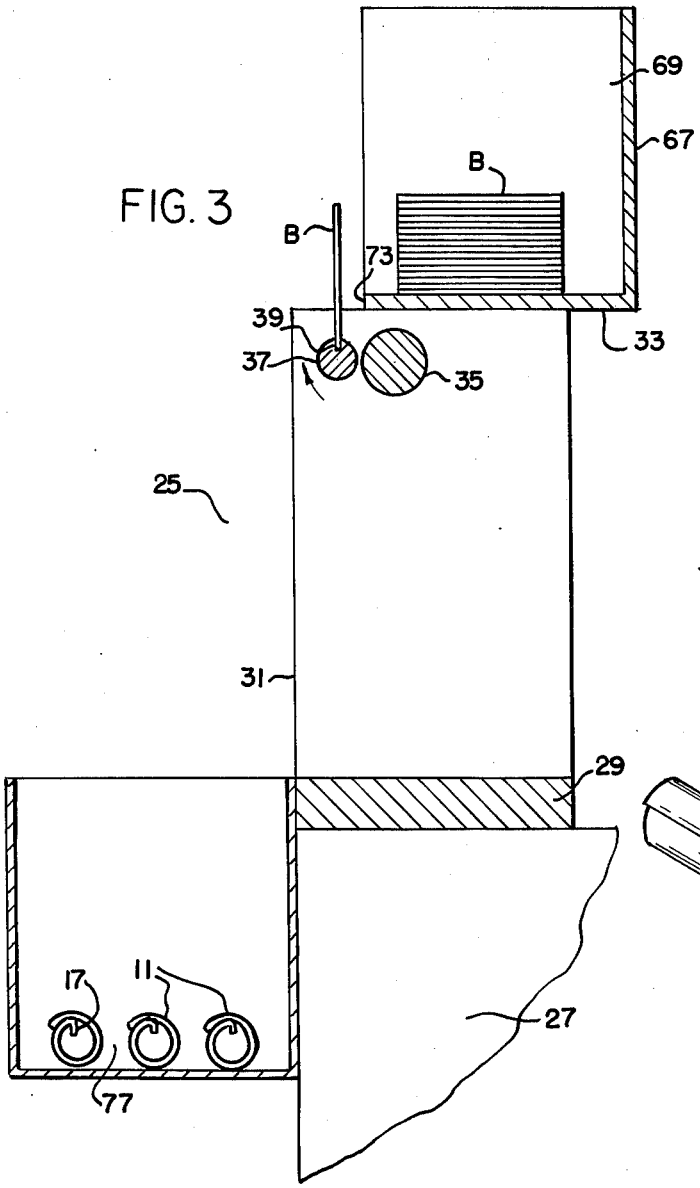
FIG. 3 is a fragmentary section on an enlarged scale taken in the direction of arrows 3—3 of FIG. 2 showing the blank before the start of the forming operation.

Said shaft throughout most of its length has upon one surface the elongated slot 39 which is adapted to supportably receive and interlockingly engage with the lower edge of one or a plurality of rectangular die blanks B such as shown in FIG. 3. The journalling and supporting of said bending roll shaft may include suitable bearings if desired, mounted upon the respective uprights 31.

The journal support 41, FIG. 2, is mounted adjacent one end of base plate 29, FIG. 2, and has suitable bearings to receive an end portion of the said roll shaft.

A drive means is provided for the bending roll shaft which, in the preferred embodiment, includes motor 43 upon a suitable support and including drive shaft 47 and is connected thereto the on/off switch 45.

Sprocket gear 49 is secured upon drive shaft 47. Driven sprocket gear 51 is keyed or otherwise secured to bending roll shaft 37 and interposed between the spacers 59 upon the journal supports 41 to restrain the driven sprocket against endwise movement relative to said bending roll shaft 37.

The forward end of the bending roll shaft has a tapered end 55 to facilitate its assembly through apertures or bearings 57 disposed within journal support 41 and the respective uprights 31 to take the use of position shown in FIGS. 1 and 2.

Handle 61 is secured upon one end of shaft 37 by which for the stripping operation said shaft may be manually retracted to the dotted line position shown at 75 sufficient to strip the respective formed cylindrical spacers 11 from the bending roll shaft 37.

The stop 63 upon journal support 41 cooperatively receives portions of the handle assembly 61 including the locator 65. This provides a means of indicating when a marking on the locator is upright, that the blank receiving slot 39 within the bending roll shaft is also in an upright position for receiving the series of blanks B.

The present apparatus for forming cylindrical spacers from metal blanks contemplates the simultaneous bending of a series of said blanks arranged along the length of the bending roll shaft. Accordingly, there are provided a series of bending stations along the length of said bending roll shaft between adjacent pairs of uprights 31 as best shown in FIGS. 1 and 2.

In order to provide a storage space for a series of stacks of blanks B ready for simultaneous bending operations along the length of the bending roll shaft, there is provided a bin which includes back wall 67 connected to the top plate 33 and including a series of longitudinally spaced upright spacer plates 69 forming a series of stock storage chambers 71.

To complete the construction of the present apparatus and to facilitate its use, there is provided forwardly of and below the base plate 29 an elongated storage bin 77 into which the completed and formed cylindrical spacers may be projected.

In connection with the present apparatus, there is also included the method of forming the present cylindrical spacers from a series of blanks B arranged in a stack which includes rotatively mounting a slotted bending roll shaft such as the shaft 37 upon a horizontal axis between the respective uprights 31.

A further step includes the assembling and interlocking of the lower edges of one or a plurality of said blanks taken from the respective stacks of blanks. A further step includes advancing the blanks and wrapping them simultaneously around the roll shaft at the same time, holding the blanks in registry with the roll shaft, utilizing the elongated stationary die bar 35. Said die bar is spaced rearwardly from the rotative bending roll shaft a distance sufficient to provide a clearance for the blank as it is rolled around said shaft as successively shown in FIGS. 4 and 5.

To accomplish the wrapping around of the respective blanks into cylindrical form around the bending roll shaft, motor 43 is momentarily energized by the switch 45, a time sufficient to permit a single rotation of the bending roll shaft. This is to assume that the final product will take the form shown in FIG. 6, being a single cylinder with an outer overlap at 15.

Should it be desired that the spacer consist of more than a single roll, rotation of the bending roll shaft could be continued for one or a series of rotations as desired, depending upon the length of stock.

Figure 4:
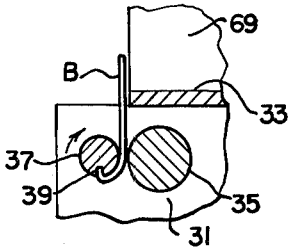
FIG. 4 is a similar but fragmentary view showing the initial forming of the spacer.
Figure 5:
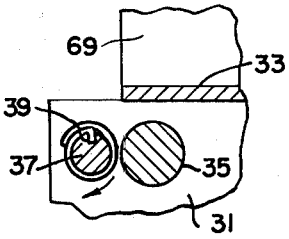
FIG. 5 is a similar view showing the completion of the forming of the cylindrical spacer.

For the primary purpose, however, of forming the metallic cylindrical spacers from blanks, such as shown in FIG. 6, it is comtemplated normally that the extent of rotation of the bending roll shaft will be approximately 360 degrees, as shown in FIGS. 3, 4 and 5. When the motor 43 is energized, the blank moves from the position shown in FIG. 3 to the preliminary initial bending stage shown in FIG. 4 with the blank loosely bearing against the die bar 35. At a position intermediate the position of the blank shown in FIG. 3 and in FIG. 3, on initial rotation of the shaft 37, the blank will engage the forward edge of top plate 33 as at the stop edge 73, shown in FIG. 3.

As the shaft 37 continues to rotate, the blank will assume the shape and position shown in FIG. 4 and wherein, the shaft 37 has rotated merely 180 degrees. As the shaft continues to rotate from the position shown in FIG. 4 to the position shown in FIG. 5, the blank is yieldably held against the bending shaft around which it is rolled until it takes the final form shown in FIG. 5. At that time the motor is de-energized either through the switch 45 or in some automatic manner which breaks the circuit to the motor. For example, a secondary switch of disc or cam shape could be applied directly to the shaft 47 should it be desired to interrupt operation of the motor at any particular angular position of said shaft.

As above described, a series of blanks B such as five, as shown in the illustrative embodiment, have now been simultaneously formed into the cylindrical spacers as shown in FIG. 6 but surrounding the bending roll shaft 37. As a final step, it is now necessary to manually retract the bending roll shaft from the solid line position shown, to some intermediate dash line position such as the exaggerated dash line position shown at 75. The shaft is withdrawn until the shaft has cleared the last of the spacers 13 at one end of the apparatus. Stripping is completed with the one ends of the respective spacers bearing against the adjacent upright 31 so that the final formed spacers will drop upon base plate 29 for storage within bin 77.

The present apparatus can be utilized by the small artisan such as the man in the gutter business wherein, the present spacers are used as gutter spacers for the gutters used in dwellings and other buildings. Since the small operator does not need a large supply of these spacers, he can, at his plant or on site, make up spacers as needed either by utilizing a single stack of blanks B or more preferably, a plurality of such stacks within the respective bin 71 so that there can be simultaneously formed with one rotation of the bending roll shaft 37 five spacers. After the formation of such five spacers, they must be stripped from the bending roll shaft and thereafter, then another five blanks can be inserted in an upright position as shown in FIG. 3 down into the upwardly opening anchoring slot 39 formed within said bending roll shaft.

I claim:

1. Apparatus for forming cylindrical spacers from metal blanks comprising a horizontally disposed base plate mountable upon a support;

longitudinally spaced uprights upon said base plate;

a die bar spaced from and parallel to said base plate spanning and secured to said supports;

a bending roll shaft parallel to and spaced from said die bar extending through and rotatively journalled upon said uprights;

said shaft having an elongated slot adapted to supportably and retainingly receive the edge of a blank;

rotative drive means connected to said roll shaft;

said blanks being guidably interposed between said roll shaft and die bar and adapted to wrap around said roll shaft during rotation thereof;

means to strip the formed spacer from said roll shaft;

said roll shaft adapted for rotation 360° approximately to complete said spacer;

said die bar being a rod of circular cross section;

and said strip means including said roll shaft adapted for longitudinal retraction relative to the formed spacer, said spacer being retained against one of said uprights, said roll shaft and die bar being spaced apart a distance approximately the thickness of said blank;

there being a series of said uprights upon said base plate, defining a plurality of bending stations along the length of said bending roll shaft; whereby a series of blanks may be assembled onto said roll shaft and simultaneously formed into spacers; and strip means including said roll shaft adapted for longitudinal retraction relative to said uprights, said spacers bearing against an adjacent upright so that retraction of said roll shaft simultaneously strips all spacers therefrom.

* * * * *